US009153176B2

(12) United States Patent
Jun et al.

(10) Patent No.: US 9,153,176 B2
(45) Date of Patent: Oct. 6, 2015

(54) DISPLAY DEVICE AND METHOD OF DRIVING THE SAME

(71) Applicant: Samsung Display Co., Ltd., Yongin (KR)

(72) Inventors: Bong-Ju Jun, Yongin (KR); Weon-Jun Choe, Yongin (KR)

(73) Assignee: Samsung Display Co., Ltd., Yongin (KR)

( * ) Notice: Subject to any disclaimer, the term of this patent is extended or adjusted under 35 U.S.C. 154(b) by 0 days.

(21) Appl. No.: 14/026,629

(22) Filed: Sep. 13, 2013

(65) Prior Publication Data

US 2014/0354710 A1 Dec. 4, 2014

(30) Foreign Application Priority Data

May 13, 2013 (KR) ..... 10-2013-0062963

(51) Int. Cl.
*G09G 3/32* (2006.01)

(52) U.S. Cl.
CPC ..... *G09G 3/3275* (2013.01); *G09G 2320/0233* (2013.01); *G09G 2320/06* (2013.01)

(58) Field of Classification Search
CPC ..... G09G 2320/048; G09G 2320/064; G09G 2300/06; G09G 2310/0205; G09G 2310/021; G09G 3/20; G09G 3/32; G09G 3/3275; G09G 3/36
USPC ..... 345/204, 690
See application file for complete search history.

(56) References Cited

U.S. PATENT DOCUMENTS

| | | | | |
|---|---|---|---|---|
| 2002/0008696 | A1* | 1/2002 | Wagner | 345/204 |
| 2010/0329553 | A1* | 12/2010 | Shiokawa et al. | 382/167 |
| 2011/0115829 | A1* | 5/2011 | Ito et al. | 345/690 |
| 2012/0062622 | A1* | 3/2012 | Koyama et al. | 345/690 |
| 2013/0300772 | A1* | 11/2013 | Kim | 345/690 |

FOREIGN PATENT DOCUMENTS

| | | |
|---|---|---|
| KR | 10-2007-0025871 | 3/2007 |
| KR | 10-2008-0114172 | 12/2008 |
| KR | 10-2010-0030978 | 3/2010 |
| KR | 10-2011-0042873 | 4/2011 |
| KR | 10-2012-0114988 | 10/2012 |

* cited by examiner

*Primary Examiner* — Saiful A Siddiqui
(74) *Attorney, Agent, or Firm* — H.C. Park & Associates, PLC

(57) ABSTRACT

A display unit including pixels which display an image according to an image data signal transferred corresponding to each of the pixels, and a controller to receive and convert an external input video signal to transfer a luminance conversion data signal corresponding to the respective pixels. The controller includes: an input image data to receive the external input video signal; a scale factor calculation unit to determine at least one control factor for luminance conversion with respect to an input video signal corresponding to the pixels received from the input image data receiving unit; and a luminance data conversion unit to convert luminance data with respect to the respective pixels using the at least one determined control factor and to output the luminance conversion data signal.

8 Claims, 10 Drawing Sheets

DISPLAY DEVICE AND METHOD OF DRIVING THE SAME

CROSS-REFERENCE TO RELATED APPLICATION

This application claims priority from and the benefit of Korean Patent Application No. 10-2013-0062963, filed on May 31, 2013, which is incorporated by reference for all purposes as if fully set forth herein.

BACKGROUND

1. Field

Exemplary embodiments of the present invention relate to a display device and a method of driving the same and, more particularly, to a method of implementing a low power consumption drive and a display device thereof.

2. Discussion of the Background

In recent years, various types of flat panel displays having reduced weight and is volume have been developed.

For example, flat panel displays include a liquid crystal display (LCD), a field emission display (FED), a plasma display panel (PDP), and an organic light emitting diode (OLED).

Among flat panel displays, the organic light emitting diode (OLED) display refers to a flat display using electro-luminescence of an organic material. Electrons and holes are injected from electrodes, and light emitting is achieved when an excitation generated by coupling of holes and electrons falls from an exited state.

Because the OLED display does not require an additional light source, the thickness and weight thereof may be reduced. Since the OLED display has a fast response speed, low power consumption, superior luminous efficiency, superior luminance, and a wide viewing angle, portable OLED displays are used for electronic products, such as a portable terminal or a large television.

The OLED display displays an image using an organic light emitting element, which is an emissive device, and emits light according to a variation in a current amount depending on an image data signal. Accordingly, if bright light of a high grayscale is displayed, current consumption is increased, so low power driving is needed for various displays.

The above information disclosed in this Background section is only for enhancement of understanding of the background of the invention and therefore it may contain information that does not form the prior art that is already known in this country to a person of ordinary skill in the art.

SUMMARY

Exemplary embodiments of the present invention provide a display device and a method of driving the same with low power consumption, by performing luminance modulation of an input image.

Exemplary embodiments of the present invention also provide a display device and a method of driving the same which may prevent quality degradation of an image by detecting and processing a high luminance region, and which may drive a display screen of high quality by more exactly processing the image using location information of the high luminance region.

Additional features of the invention will be set forth in the description which follows, and in part will be apparent from the description, or may be learned by practice of the invention.

An exemplary embodiment of the present invention discloses a display device including a display unit including pixels to display an image according to an image data signal transferred corresponding to each of the pixels, and a controller to receive and convert an external input video signal to transfer a luminance conversion data signal corresponding to the respective pixels.

The controller may include: an input image data receiving unit to receive the external input video signal; a scale factor calculation unit to determine at least one control factor for luminance conversion with respect to an input video signal corresponding to the pixels received from the input image data receiving unit; and a luminance data conversion unit to convert luminance data with respect to the respective pixels using the at least one determined control factor and to output the luminance conversion data signal.

An exemplary embodiment of the present invention also discloses a method of driving a display device including a display unit including pixels to display an image according to an image data signal transferred corresponding to each of the pixels and a controller to receive and convert an external input video signal to transfer a luminance conversion data signal corresponding to the respective pixels. The method of driving a display device includes receiving the external input video signal to determine at least one control factor for luminance conversion with respect to an input video signal corresponding to the pixels; converting luminance data with respect to the pixels using the determined at least one control factor; and outputting the converted luminance conversion data signal to display an image on the display unit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
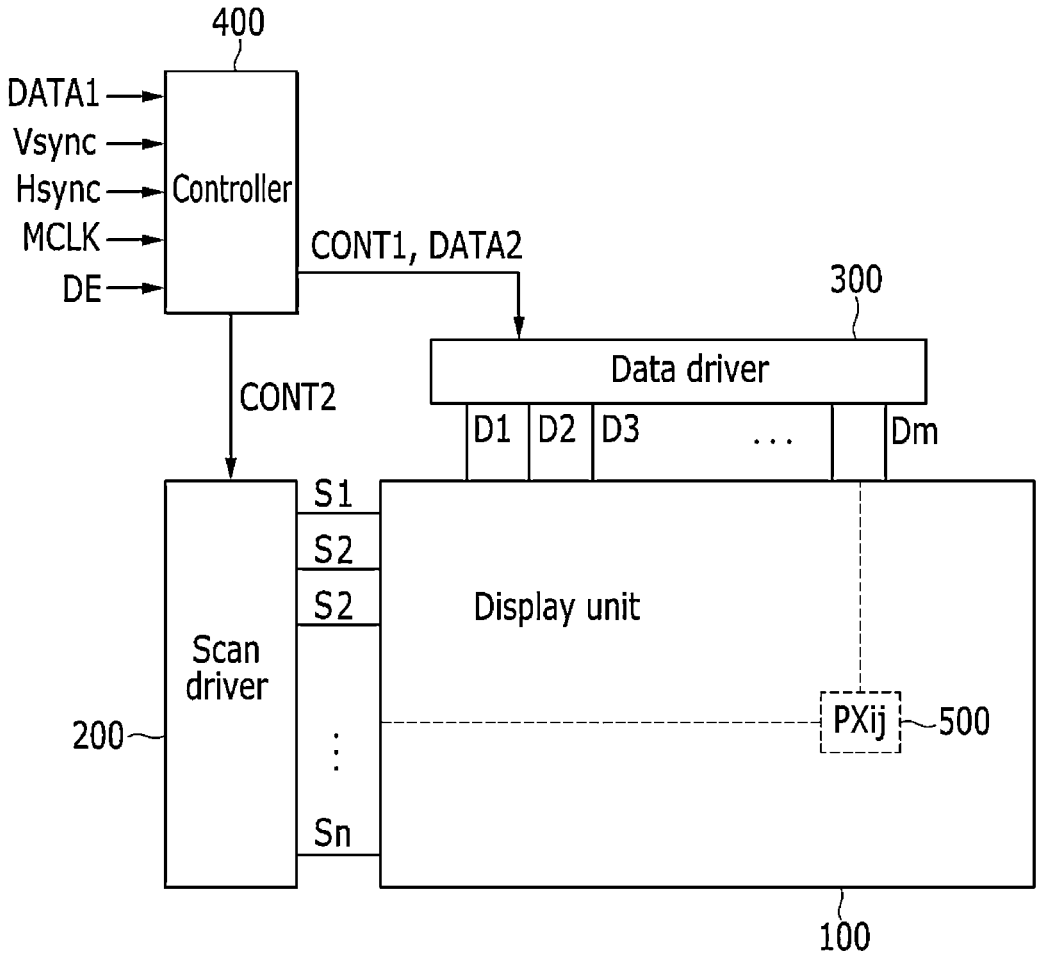
FIG. 1 is a block diagram illustrating a configuration of a display device according to an exemplary embodiment.

The invention is described more fully hereinafter with reference to the accompanying drawings, in which exemplary embodiments of the invention are shown. This invention may, however, be embodied in many different forms and should not be construed as is limited to the exemplary embodiments set forth herein. Rather, these exemplary embodiments are provided so that this disclosure is thorough, and will fully convey the scope of the invention to those skilled in the art. In the drawings, the size and relative sizes of elements may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element or layer is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

Furthermore, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram illustrating a configuration of a display device according to an exemplary embodiment.

Referring to FIG. 1, the display device includes a display unit 100 having pixels 500, a scan driver 200, a data driver 300, and a controller 400.

The display unit 100 includes pixels 500 connected to corresponding scan lines among scan lines S1-Sn and corresponding data lines among data line D1-Dm. Each of the pixels 500 displays an image corresponding to an image data signal DATA2 to be transferred to is the corresponding pixel.

The pixels 500 are connected to scan lines S1-Sn and data lines D1-Dm and are arranged in a matrix pattern. The scan lines S1-Sn extend in a row direction parallel with each other. The data lines D1-Dm extend in a column direction parallel with each other. The pixels 500 in the display unit 100 receive a driving power source voltage from an external power supply.

The scan driver 200 is connected to the display unit 100 through the scan lines S1-Sn. The scan driver 200 generates scan signals capable of activating respective pixels of the display unit 100 according to a scan control signal CONT2, and transfers the generated scan signals to corresponding scan lines among the scan lines S1-Sn.

The scan control signal CONT2 is an operation control signal of the scan driver 200, which is generated and transferred by the controller 400. The scan control signal CONT2 may include a scan start signal and a clock signal. The scan start signal is a signal to generate a first scan signal for displaying an image of one frame. The clock signal is a synchronous signal to sequentially apply a scan signal to the scan lines S1-Sn.

The data driver 300 is connected to the respective pixels 500 of the display units 100 through the data lines D1-Dm.

The data driver 300 receives an image data signal DATA2 and transfers the received image data signal DATA2 to a corresponding data line among the data lines D1-Dm according to the data control signal CONT1. In this case, the image data signal DATA2 is a data signal obtained by converting luminance data of the external input video signal DATA1 from an external image source to an Equivalent Luminance with Lower Power (ELLP) scheme. Hereinafter, the image data signal DATA2 refers to a luminance conversion data signal.

The data control signal CONT1 is an operation control signal of a data driver 300 generated and transferred by the controller 400. Although not shown in FIG. 1, the data control signal CONT1 may include an operation control signal to process a luminance conversion data signal DATA2 with the data driver 300 according to a video signal input from an external image source.

The data driver 300 selects a gray voltage according to a luminance conversion data signal DATA2, which is image-processed and finally output by the controller 400. The data driver 300 transfers the selected gray voltage to data lines D1-Dm.

The controller 400 receives a video signal DATA1 input from an external source and an input control signal for controlling display thereof. The video signal DATA1 includes luminance of respective pixels of the display unit 100, and the luminance has a preset number of, for example, $1024=2^{10}$, $256=2^{8}$, or $64=2^{6}$ grayscales. The video signal DATA1 is luminance-converted through luminance correction in a luminance range (hereinafter, referred to as "non-recognition luminance range"), which a viewer cannot recognize, by the controller 400 in order to drive at low power. A procedure of converting luminance within the non-recognition luminance range by the controller 400 will be described in detail with reference to following drawings.

The controller 400 transfers a luminance conversion data signal DATA2 generated by performing the procedure of converting luminance to the data driver 300.

For example, input control signals transferred to the controller 400 include a vertical synchronization signal Vsync, a horizontal synchronization signal Hsync, a main clock MCLK, and a data enable signal DE.

The controller 400 image-processes an input video signal DATA1 suited to an is operation condition of the display unit 100 and the data driver 300 based on the input external video signal DATA1 and the input control signal. The processing of the image includes controlling a luminance rate by pixels and by frames, and converting luminance data of an input video signal DATA1 according to the controlled luminance rate.

Further, the controller 400 transfers a scan control signal CONT2 to the scan driver 200 for controlling an operation of the scan driver 200. The controller 400 generates a data control signal CONT1 of the data driver 300.

Figure 2:
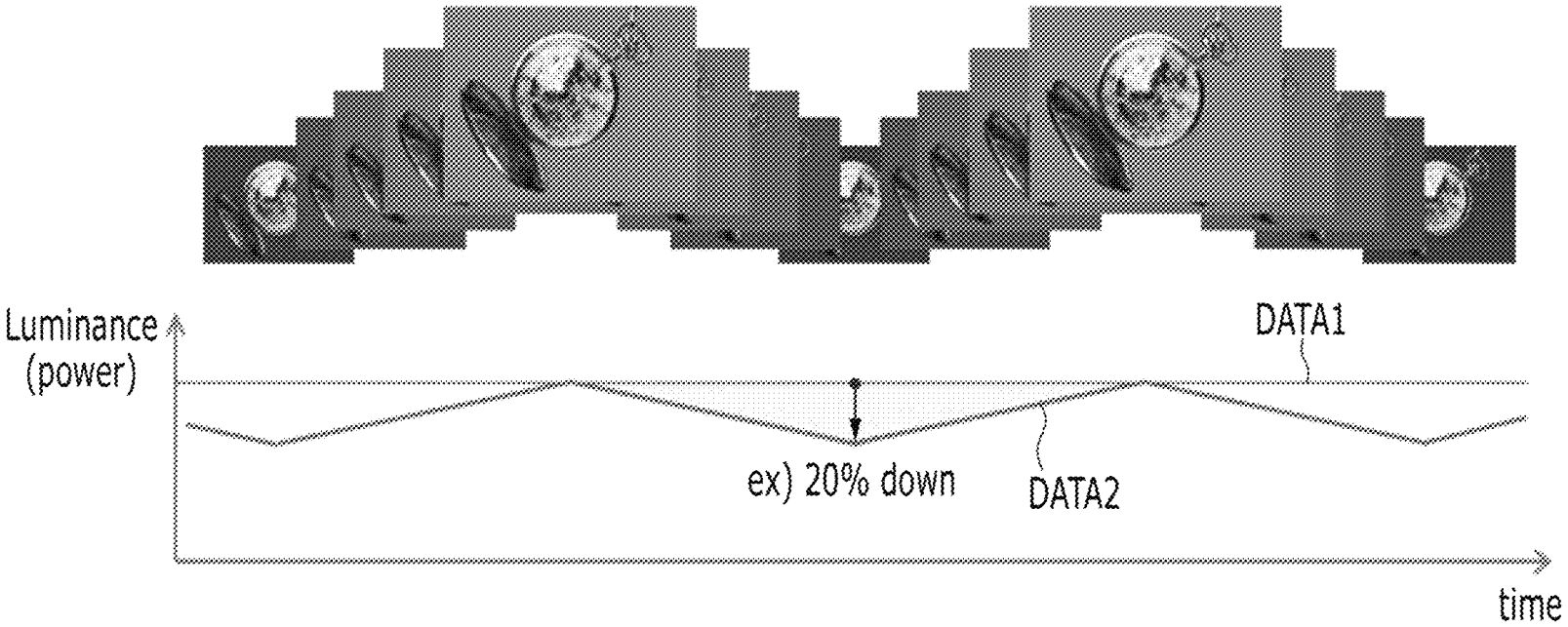
FIG. 2 is a graph schematically illustrating a principle of a method of driving the display device according to an exemplary embodiment.

FIG. 2 is a graph schematically illustrating a principle of a method of driving the display device according to an exemplary embodiment.

When light is emitted with luminance data according to an input video signal DATA1, and luminance between frames is changed, the viewer does not recognize a luminance change within a luminance range, which may be referred to as a "non-recognition luminance range".

If a brightness value corresponding to original luminance data is reduced within a non-recognition luminance range, a visual sensor of a human cannot recognize it. However, the display device according to an exemplary embodiment repeatedly increases and reduces the input video signal DATA1 within a non-recognition luminance range, as illustrated in FIG. 2, to generate luminance conversion data signal DATA2, which is converted in a unit of a frame.

According to the exemplary embodiment of FIG. 2, if the luminance of an original video signal DATA1 is reduced by a maximum of 20%, a person cannot recognize the reduction in luminance. A luminance conversion data signal DATA2 is calculated by increasing/reducing luminance according to luminance data within a luminance range of 20%. Accordingly, a brightness value varies as compared with luminance according to a real video is signal DATA1 so that driving power consumption may be reduced without noticeably reducing luminance.

In an example of a graph shown in FIG. 2, an increase and a reduction of luminance is repeated within a luminance range by a maximum of 20%, as compared with luminance of the original luminance data. Fundamentally, as shown in the graph of FIG. 2, luminance is repeatedly increased and reduced in a repeated unit period of a preset number of frames. That is, the repeated unit period may be determined as the number of corresponding frames from a maximum luminance value to a next maximum value, or from a minimum luminance value to a next minimum luminance value, and the repeated unit period may be set as a preset value.

Figure 3:
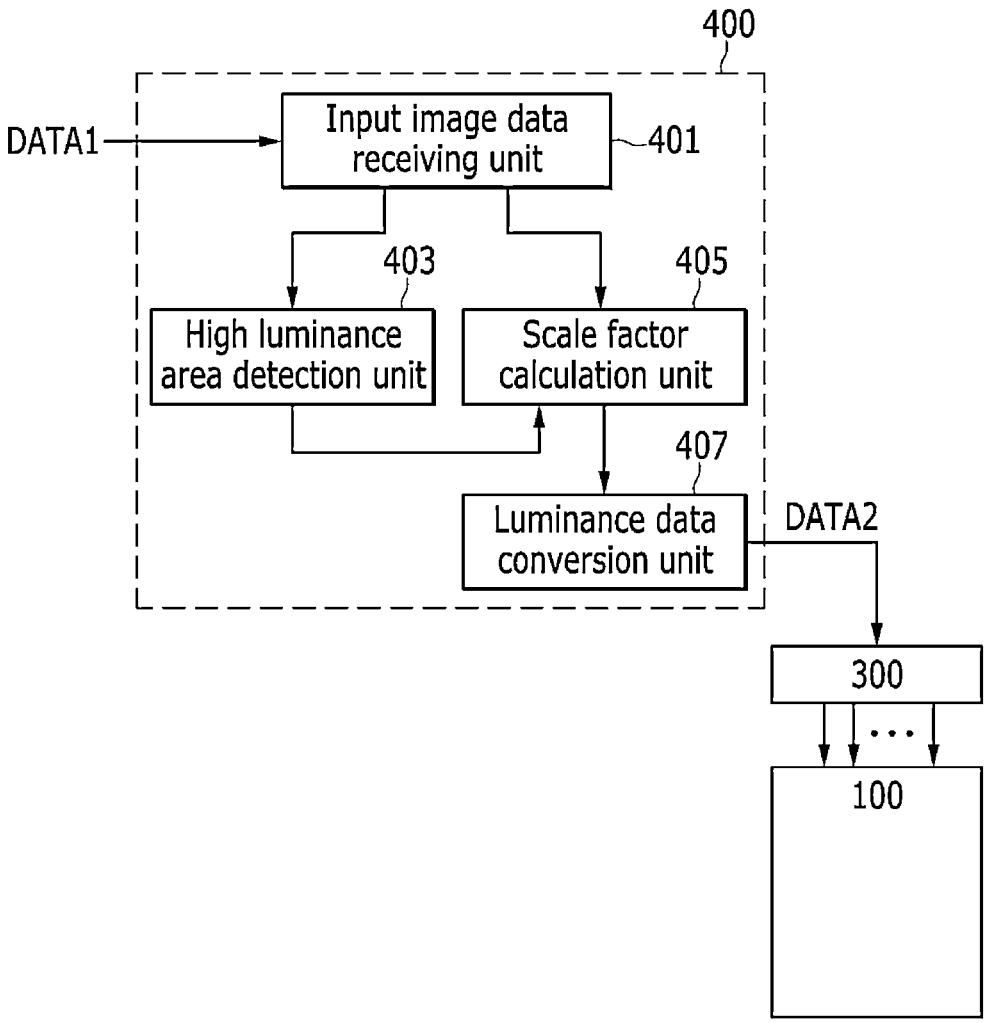
FIG. 3 is a block diagram schematically illustrating a configuration of a controller is of the display device FIG. 1 according to the exemplary embodiment shown in FIG. 1.

FIG. 3 is a block diagram schematically illustrating a configuration of a controller of the display device FIG. 1 according to the exemplary embodiment shown in FIG. 1.

The controller 400 of FIG. 3 includes an input image data receiving unit 401, a high luminance region detection unit 403, a scale factor calculation unit 405, and a luminance data conversion unit 407 in order to acquire luminance conversion data signal DATA2 obtained by controlling a luminance within a non-recognition luminance range, as shown in FIG. 2. However, the controller 400 is not limited to the exemplary embodiment. That is, various exemplary embodiments of a configuration to convert luminance data within a non-recognition luminance range may be included.

The input image data receiving unit 401 receives an input video signal DATA1 from an external image source. The input image data receiving unit 401 receives video signals by frames and by corresponding pixels including original luminance information in real time.

The high luminance region detection unit 403 receives luminance information of is the receiver video signal DATA1 to detect a high luminance region greater than a reference luminance.

When at least one high luminance region is detected from some pixel areas configured by pixels among the entire display unit 100 during frames among frames in the video signal, luminance conversion of a corresponding high luminance region and luminance conversion in a remaining background (i.e., remaining region on the display unit except for the high luminance region) may both be performed.

A method of detecting the luminance region by the high region detection unit 403 will later be described with reference to FIGS. 6 to 10.

The scale factor calculation unit 405 calculates a control factor (scale factor) for luminance conversion with respect to an input video signal DATA1 received by the input image data receiving unit 401. Further, when there is a detected high luminance region with respect to an input video signal DATA1 by the high luminance region detection unit 403, the scale factor calculation unit 405 receives luminance data with respect to a corresponding high luminance region from the high luminance region detection unit 403 to calculate a control factor of luminance conversion by pixels and frames with respect to the high luminance region.

The control factor, that is, the scale factor refers to a reference parameter to control increase and decrease of the luminance for low power drive in a non-recognition luminance range with respect to luminance information included in the original video signal.

Figure 4:
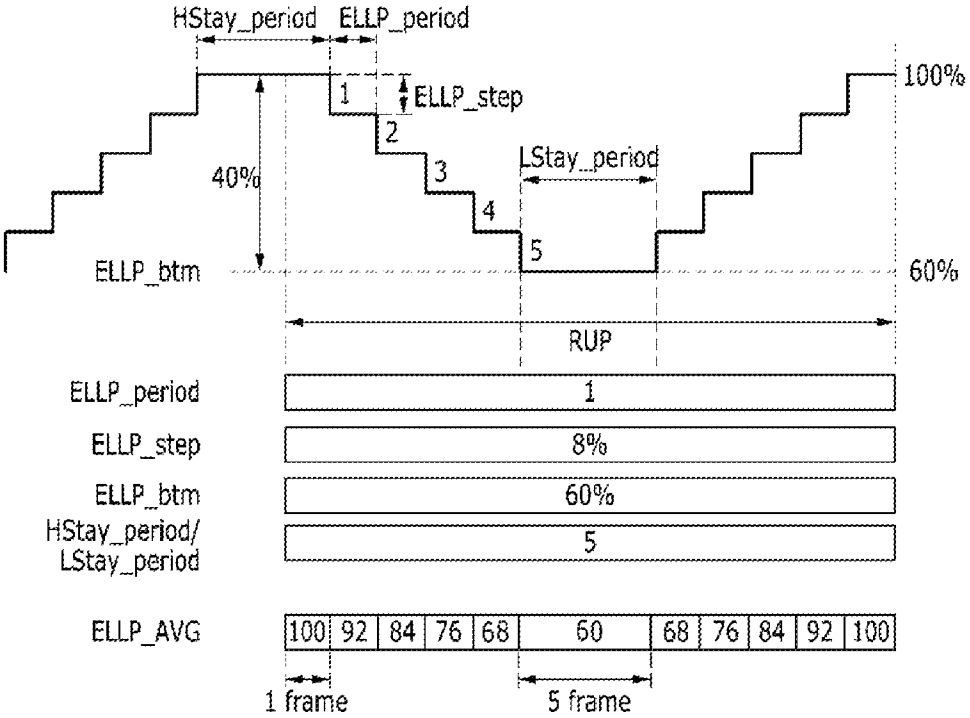
FIG. 4 is a diagram illustrating a waveform illustrating a method of driving the display device according to the exemplary embodiment and an example of scale factors according thereto.

FIG. 4 is a diagram illustrating a waveform illustrating a method of driving the display device according to the exemplary embodiment and an example of scale factors according thereto.

Referring to FIG. 4, scale factors controlled within the non-recognition luminance is range with respect to the video signal are illustrated.

According to an exemplary embodiment, the luminance is repeatedly increased and reduced within a time period in the non-recognition luminance range. That is, as illustrated in FIG. 4, an interval from a frame of a maximum luminance value implementing luminance information of 100% with respect to an original signal to a frame of the next maximum luminance value may be set as a repeated unit time period (RUP). The scale factor includes the repeated unit period RUP.

The scale factor may include sustain periods ELLP_period by steps, luminance variation step ELLP_step, a lower luminance variation limit ELLP_btm, an upper luminance sustain period HStay_period, a lower luminance sustain period LStay_period, a non-recognition luminance range, and a luminance variation rate ELLP_AVG by frames corresponding to the luminance variation step, as well as the repeated unit time period RUP.

The sustain periods ELLP_period by steps refers to a frame and a time period sustaining a reduced or increased luminance value after the luminance is reduced or increased. In FIG. 4, the sustain periods ELLP_period by steps is set as a 1 frame. That is, light is emitted and maintained with a varied luminance value corresponding to the pixel with reference to the one frame.

The luminance variation step ELLP_step is the number of steps of the luminance variation, which is the number of an increase or a reduction steps from a time reduced to the minimum luminance to a time increased to a maximum luminance. The reduction luminance variation step and the increased luminance variation step may be the same as or be different from each other.

In FIG. 4, the luminance variation step ELLP_step is set as five steps. That is, the is luminance value varies during the five steps from the maximum luminance value to the minimum luminance value, and during five steps from the minimum luminance value to the maximum luminance value.

Luminance variation rates ELLP_AVG by frames may be determined according to the luminance variation step ELLP_step. That is, if the non-recognition luminance range is set, the luminance variation rate ELLP_AVG of the frame by a reduction or an increase in the number of steps may be determined by dividing the non-recognition luminance range (%) by the luminance variation step. In FIG. 4, if a brightness value according to luminance data of an original input video signal is set to 100%, the non-recognition luminance range is set to 40%. Since the luminance variation step ELLP_step is five steps, a luminance variation rate ELLP_AVG by frames having 8% may be calculated. Accordingly, as illustrated in FIG. 4, if a luminance variation ratio ELLP_AVG of 100% is set to a first frame (1 frame), luminance variation ratios ELL- P_AVG by frames are reduced in a unit of 8% every luminance variation step ELLP_step, and may be reduced in the order of 92%, 84%, 76%, 68%, and 60%. In the increase procedure, conversely, luminance variation ratios ELLP_AVG by frames are increased and become a maximum luminance value of 100%.

The lower luminance variation limit ELLP_btm is a parameter corresponding to a non-recognition luminance range. The lower luminance variation limit ELLP_btm refers to a percentage of the minimum luminance value in a range which the person cannot recognize if a brightness value according to luminance information included in the original input video signal is set to 100%. That is, the lower luminance variation limit ELLP_btm refers to a value obtained by subtracting a non-recognition luminance range from a maximum luminance of the input image. In an example of FIG. 4, since 40% is set as the non-recognition luminance range, 60% is calculated as the lower luminance variation limit ELLP_btm.

Figure 5:
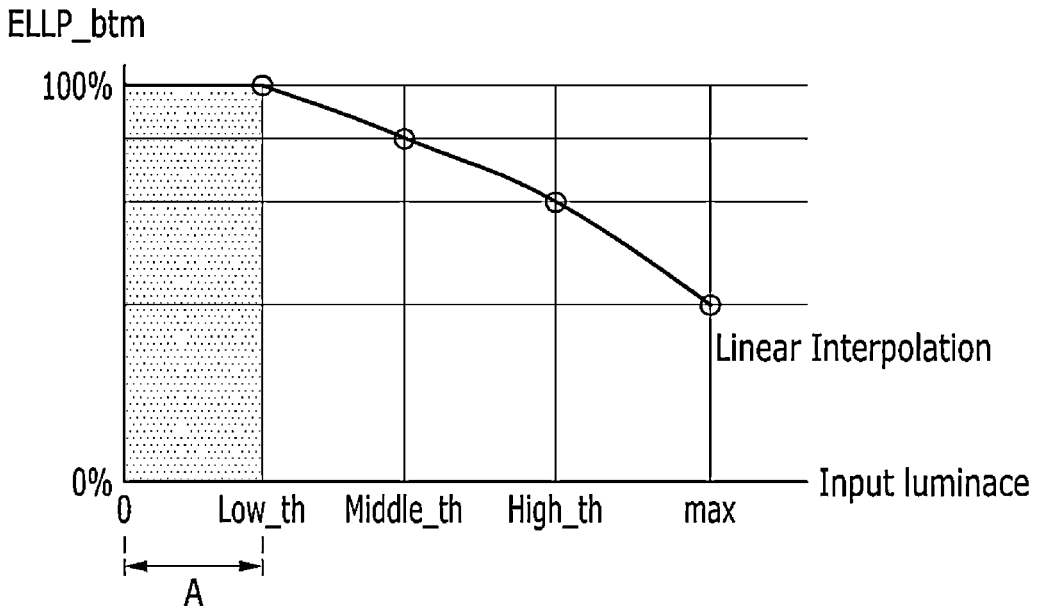
FIG. 5 is a graph illustrating a graph illustrating a preset example of a lower luminance variation limit among the scale factors according to the exemplary embodiment shown in FIG. 4.

FIG. 5 is a graph illustrating a preset example of a lower luminance variation limit among the scale factors, according to the exemplary embodiment shown in FIG. 4.

The lower luminance variation limit ELLP_btm is determined as a ratio with respect to original luminance information of the input video signal. In a case of a low grayscale, since a luminance level of 100% has an absolutely small luminance value, it is necessary to reduce the luminance variation amount by relatively increasing a lower limit. In contrast, in a case of a high grayscale, a luminance level of 100% has an absolutely large luminance value, the non-recognition luminance range is increased to relatively reduce a lower limit so that a luminance variation ratio may be increased. Accordingly, as illustrated in a graph of FIG. 5, the scale factor calculation unit 405 sets a low grayscale reference value Low_th, an intermediate grayscale reference value Middle_th, a high grayscale reference value High_th, and the highest grayscale value max, and may calculate a lower luminance variation limit ELLP_btm with regions between grayscales. The lower luminance variation limit ELLP_btm is obtained using at least the low grayscale reference value Low_th, the intermediate grayscale reference value Middle_th, the high grayscale reference value High_th, and the highest grayscale value max as a residual intermediate value through interpolation. However, in the low grayscale region A from the minimum grayscale value 0 to the low grayscale reference value Low_th, the lower luminance variation value ELLP_btm sustains a luminance level of 100% as is. Accordingly, in the low grayscale region A, the image is implemented according to luminance of the original video signal without variation of the luminance variation ratio according to an exemplary embodiment of the present invention.

Further, the upper luminance sustain period HStay_period refers to a frame period is which sustains a brightness value of 100% according to luminance information included in the original input video signal, and the lower luminance sustain period LStay_period refers to a frame period which sustains the lower luminance variation limit ELLP_btm within a non-recognition luminance range. Although the upper luminance sustain period HStay_period and the lower luminance sustain period LStay_period may be set as the same frame period, the present invention is not limited thereto.

In the exemplary embodiment of FIG. 4, the upper luminance sustain period HStay_period and the lower luminance sustain period LStay_period are set as 5 frames, respectively.

When the upper luminance sustain period HStay_period and the lower luminance sustain period LStay_period are set as frame periods, the repeated unit period RUP may be set as a time period from an intermediate time point of the upper luminance sustain period HStay_period to an intermediate of the lower luminance sustain period LStay_period.

Referring back to FIG. 3, the scale factor calculation unit 405 determines the scale factors as described above with respect to the input video signal DATA1.

Further, when the high luminance region calculation unit 403 detects the high luminance region, the scale factor calculation unit 405 may receive video signals with respect to the detected high luminance region and remaining background region to calculate and determine scale factors by regions.

The luminance data conversion unit 407 determines luminance variation ratios by pixels and frames with respect to a video signal DATA1 according to a scale factor determined by the scale factor calculation unit 405, and accordingly converts the luminance data. That is, the same luminance level as luminance information included in the input video signal DATA1 is is regulated as 100%, and a luminance variation ratio to a designated lower luminance variation limit ELLP_btm is determined using the calculated scale factors. While sustaining a luminance value of 100% during the upper luminance sustain period HStay_period, light is emitted with a luminance value obtained by varying luminance variation ratio ELLP_AVG by frames every luminance variation step ELLP_step during sustain periods ELLP_period by steps. Accordingly, luminance data with respect to the input video signal are converted by repeatedly forming a luminance value waveform to repeatedly perform a luminance value waveform where the luminance is increased to a luminance value of 100% after sustaining the determined lower luminance variation limit ELLP_btm during the lower luminance sustain period LStay_period.

The luminance data conversion unit 407 calculates a luminance conversion data signal DATA2 including luminance information corrected according to a luminance variation ratio changed during progress of the frame, and transfers the luminance conversion data signal DATA2 to the data driver 300.

The data driver 300 receives a data voltage corresponding to the transferred luminance conversion data signal DATA2, and respective pixels of the display unit 100 emit light to display an image in which the luminance variation ratio is reflected. Since the image is changed and displayed while a luminance ratio progresses within a range which is not recognized by a viewer, the viewer can reduce driving power consumption of the display device without sensing luminance variation.

A method of detecting a high luminance by a high luminance region detection unit 403 included in the controller 400 of FIG. 3 will be described with reference to FIGS. 6 to 10.

Figure 6:
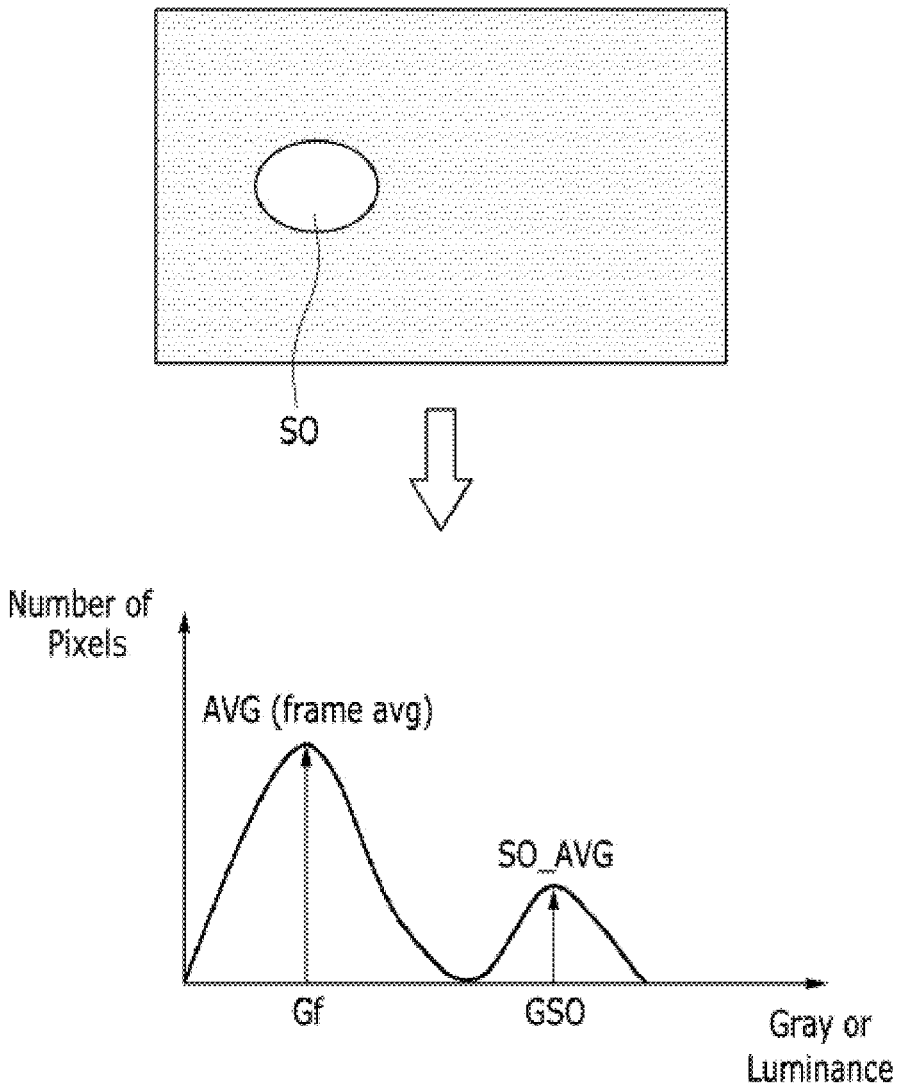
FIG. 6 is a graph illustrating a histogram of input image data and detection of a high luminance region according thereto.
Figure 7:
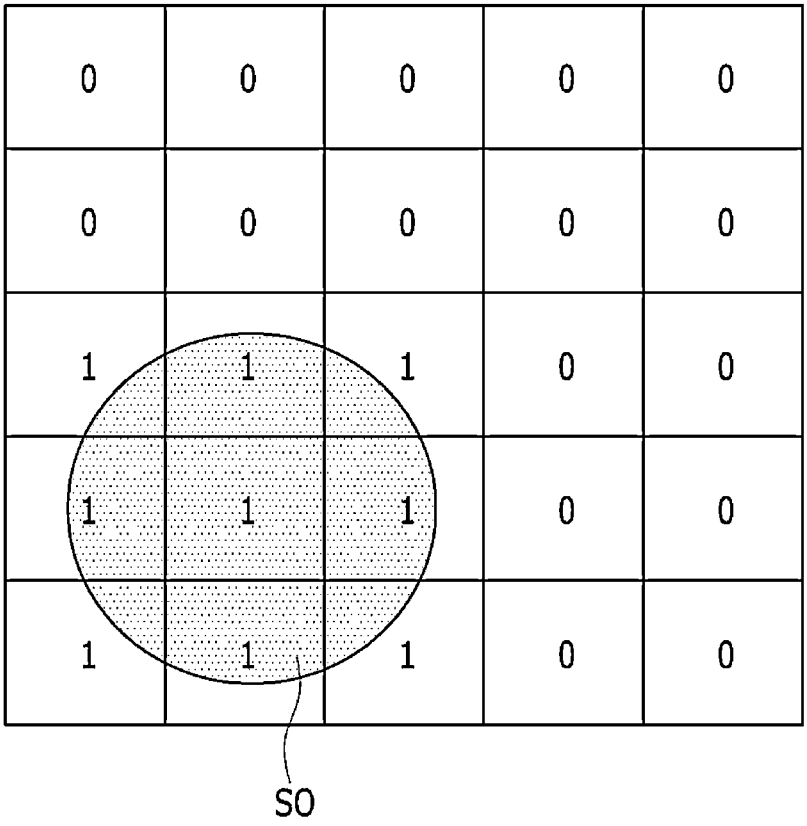
FIG. 7 is a diagram illustrating detection of a luminance region using a flag map of input image data.
Figure 8:
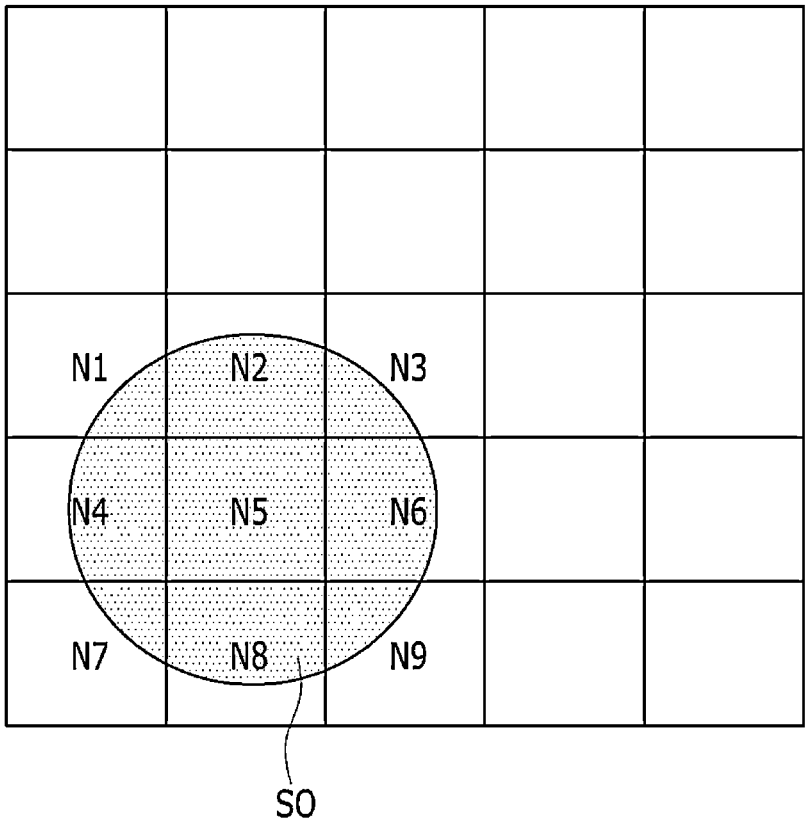
FIG. 8 is a diagram illustrating detection of high luminance region using block luminance information of a display panel.

FIG. 6 is a graph illustrating a histogram of input image data and detection of a is high luminance region according thereto, and FIG. 7 is a diagram illustrating detection of a luminance region using a flag map of input image data. In addition, FIG. 8 is a diagram illustrating detection of high luminance region using block luminance information of a display panel.

When the image with respect to the input video signal is implemented, a region (high luminance region) having a luminance value higher than a reference value may be suddenly created. In spite of the high luminance region, the high luminance region is buried in luminance modulation in a background region to be performed according to the exemplary embodiment, which may result in a deterioration in visibility.

Accordingly, when the high luminance region detection unit 403 detects the high luminance region, there is a need to control luminance so that the visibility is represented by sustaining the luminance value of the high luminance region part as the luminance value of 100%. To this end, when the high luminance region is detected, luminance data of the high luminance region are separated from luminance data of a background region so that luminance in the respective regions is controlled. A luminance control scheme converts and processes luminance information by the luminance data conversion unit 407 using scale factors generated by the scale factor calculation unit 405, as illustrated in FIG. 3.

A scheme of detecting a high luminance region SO illustrated in FIG. 6 analyzes a grayscale or a luminance value. In this case, an average luminance value SO_AVG of grayscale or luminance in the high luminance region SO is GSO, an average luminance value AVG (frame avg) of grayscale or luminance in a remaining background region except for the high luminance region SO is Gf. Accordingly, when a curved line of a background region emitting light with low luminance of Gf and a high luminance region emitting light with high luminance of GSO is is illustrated in FIG. 6, luminance information of a corresponding image data signal can be controlled by separating the two regions from each other.

According to another exemplary embodiment detecting a high luminance region, referring to FIG. 7, entire pixel areas of the display unit are divided in a unit of a block, and a flag is annexed to an image data signal corresponding to a pixel exceeding a reference luminance. Accordingly, using the flag map, as illustrated in FIG. 7, a flag with respect to the luminance region SO is recognized and a position of the high luminance region may be confirmed.

According to another exemplary embodiment detecting a high luminance region, referring to FIG. 8, entire pixel areas of the display unit 100 are divided in a unit of a block, and luminance information by blocks may be used. Blocks (N1 to N9) receiving an image data signal including luminance information of a high luminance region exceeding a reference luminance value may be included in the high luminance region, and remaining blocks may be included in the background region.

Each of the blocks includes at least one pixel, and luminance by blocks may be calculated by averaging luminance values of pixels included in the block.

In a case of FIG. 8, when an average luminance value of N1 to N9 among blocks exceeds a reference luminance, a block region of the N1 to N9 is detected as a block region, and a remaining region may be defined as a background region.

An average luminance value of the blocks N1 to N9 included in the high luminance region is determined as a luminance value of the entire luminance region.

When the high luminance region is detected in a scheme of FIGS. 6 to 8, the high luminance region is separated from the background region so that luminance data from the high is luminance region detection unit 403 are transferred to the scale factor calculation unit 405. Accordingly, the scale factor calculation unit 405 calculates respective scale factors with respect to luminance data corresponding to the luminance region and luminance data corresponding to the background region. Next, scale factors with respect to respective regions are transferred to the luminance data conversion unit 407, the luminance data conversion unit 407 applies scale factors of the high luminance region with respect to an input data signal corresponding to the high luminance region, and applies scale factors of the background region with respect to an input data signal corresponding to the background region to output a luminance conversion data signal DATA2.

Figure 9:
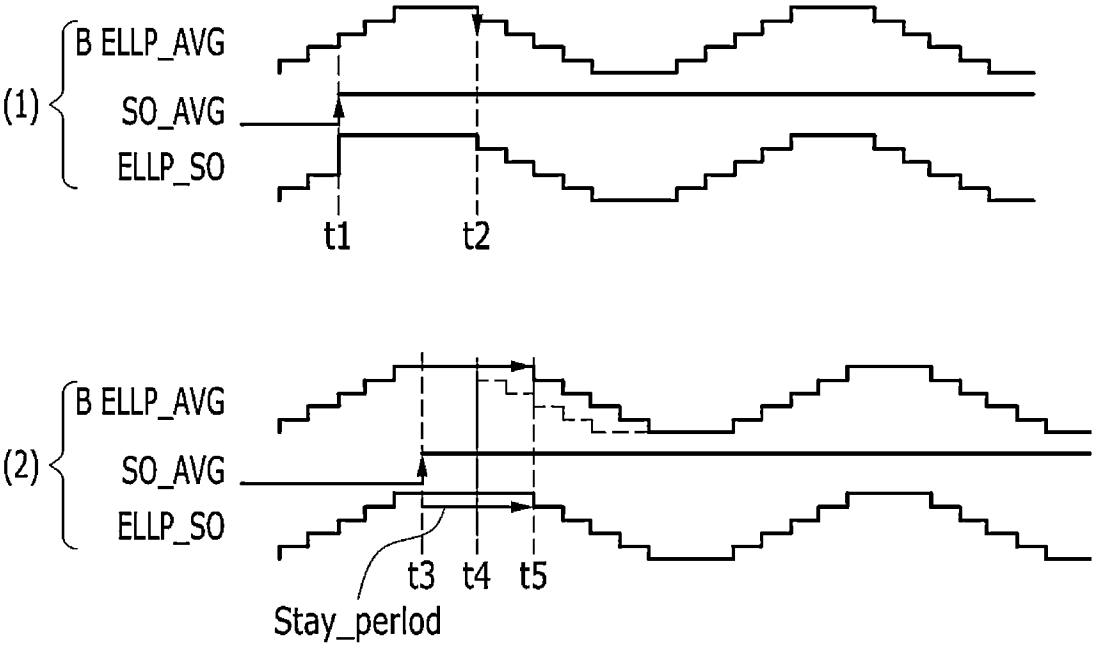
FIG. 9 is a diagram illustrating a luminance control scheme between a high luminance region and a background region detected by one scheme of FIGS. 6 to 9.

A scheme of controlling luminance with respect to a video signal included in the high luminance region is illustrated in FIG. 9.

The high luminance region is separated from the background region so that a luminance value is controlled, and luminance modulation in the background region may be equally converted by sustaining an upper luminance sustain period HStay_period of a luminance rate of 100% in the high luminance region for a preset period.

Particularly, upon detecting and applying high luminance, a luminance control operation may be differently set according to an expression time point of the high luminance region.

Referring to FIG. 9, in the first exemplary embodiment 1, when an average grayscale value SO_AVG of high luminance is increased so that the high luminance region is expressed at one time point t1 when a background region luminance variation ratio BELLP_AVG is increased to a 100% luminance ratio, a high luminance region luminance variation ratio ELLP_SO is increased to the luminance ratio of 100% so that the background is region luminance variation ratio BELLP_AVG is sustained during a time period from the upper luminance sustain interval to a falling time point t2. Next, a high luminance region luminance variation ratio ELLP_SO is equally controlled to follow a luminance variation of the luminance variation ratio BELLP_AVG.

The second exemplary embodiment 2 of FIG. 9 represents a case where an average grayscale value SO_AVG of a high luminance region is increased so that the high luminance region is expressed at one time point t3 when the background region luminance variation ratio BELLP_AVG of 100% continues for an upper luminance sustain period. In this case, the high luminance region luminance variation ratio ELLP_SO is increased to a luminance ratio of 100%, an upper luminance sustain period of 100% determined in the background region luminance variation ratio is sustained, and then the first period is additionally sustained. Next, the high luminance region luminance variation ratio ELLP_SO is equally controlled to follow a luminance variation of the background region luminance variation ratio BELLP_AVG. That is, the high luminance region luminance variation ratio ELLP_SO is increased and sustained with the luminance ratio of 100% to a time point t4, which is a finishing point of an upper luminance sustain period.

The luminance ratio of 100% sustains during the first period from a time point t4 to a time point t5. The first period is not specially limited, which is a time period before a high luminance region is expressed among total upper luminance sustain periods of the background region luminance variation ratio BELLP_AVG. That is, a time period when a luminance variation ratio BELLP_AVG of 100% is sustained before an expression time point of the high luminance region is determined as the first period so that a high luminance region luminance variation ratio ELLP_SO of 100% may be additionally sustained.

In second exemplary embodiment 2, although a finishing point of an upper luminance sustain period of an original background region luminance variation ratio BELLP_AVG is t4, the upper luminance sustain period may extend to a time point t5 when the high luminance region luminance variation ratio ELLP_SO of 100% is sustained, as shown by an arrow.

In this manner, visibility in the high luminance region can be significantly improved by controlling luminance of the high luminance region according to the first exemplary embodiment and the second exemplary embodiment suited to control of the background region luminance.

Figure 10:
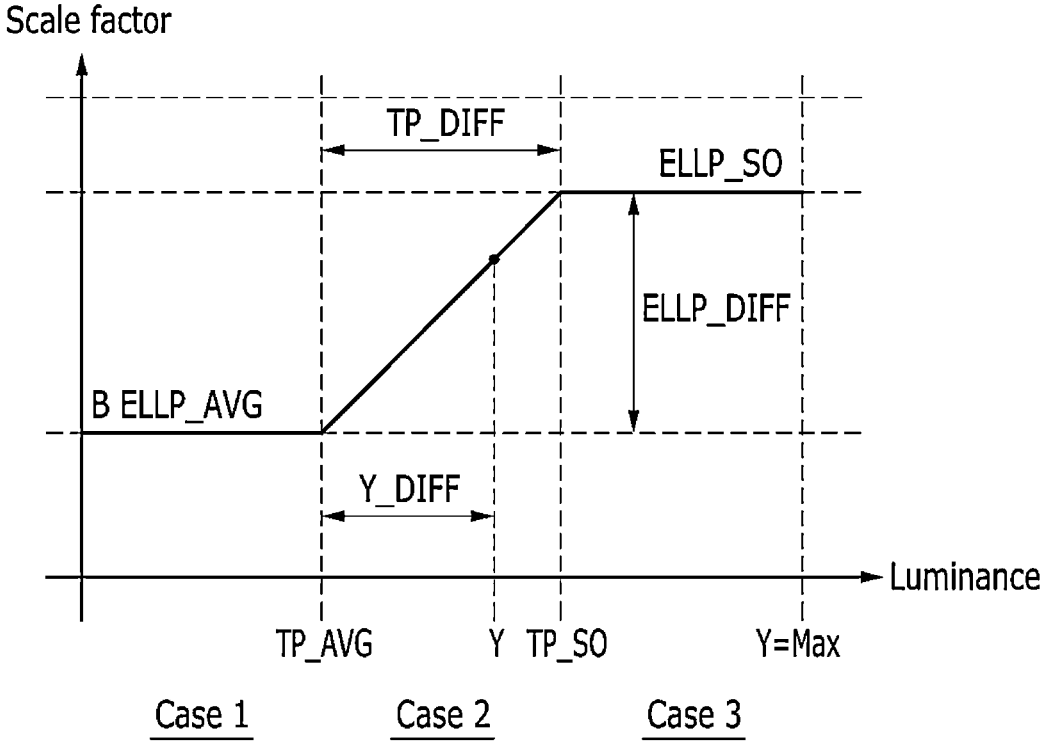
FIG. 10 is a diagram illustrating a calculation scheme of the scale factors for controlling luminance at a boundary between the high luminance region and the background region.

FIG. 10 is a diagram illustrating a calculation scheme of the scale factors for controlling luminance at a boundary between the high luminance region and the background region.

When the high luminance region is detected in the scheme shown in FIGS. 6 to 8, a boundary between the high luminance region and the background region may be unnaturally shown due to a luminance difference. To this end, scale factors to be multiplied to luminance data of an input video signal between the high luminance region and the background region may be obtained by linear interpolation as shown in FIG. 10.

That is, as illustrated in FIG. 8, when a block unit detects the high luminance region SO, blocks N1, N2, N3, N4, N6, N7, N8, and N9 may be blocks corresponding to a boundary with the background region. Accordingly, the scale factor calculation unit 405 may obtain scale factors of the background region by linear interpolation, unlike a center block N5.

In detail, an X-axis of FIG. 10 is a luminance of the display unit, a Y-axis is a scale factor, which may be one of the scale factors.

Upon division according to the luminance, the first interval (case 1) is a background region. When the third interval (case 3) is a central region of the high luminance region, the second interval (case 2) becomes a boundary of the high luminance region.

As one example, a luminance variable ratio being one scale factor will be described. A luminance variation ratio corresponding to a boundary of the second interval (case 2) may be calculated from the background region luminance variation ratio BELLP_AVG of the first interval (Case 1) and a high luminance region luminance variation ratio ELLP_SO of the third interval (Case 3).

In FIG. 10, a scale factor (luminance variation ratio) (SF) in a luminance Y corresponding to a boundary of the second interval (Case 2) may be determined by a following equation 1.

$$SF=(Y_DIFF/TP_DIFF)*ELLP_DIFF+BELLP_AVG, \quad \text{(equation 1)}$$

where BELLP_AVG represents a background region luminance variation ratio, and ELLP_DIFF represents a difference between the background region luminance variation ratio and the high luminance region luminance variation ration. Further, TP_DIFF represents a difference between the highest luminance value TP_AVG of the background region and the lowest luminance value TP_SO of the high luminance region, and Y_DIFF represents a luminance difference between the highest luminance value TP_AVG and a pixel luminance Y value of a point emitting light with Y luminance among blocks corresponding to a boundary of the high luminance region.

The scale factor calculation unit 405 obtains scale factors of a block corresponding to a boundary between the boundary region and the high luminance region using is linear interpolation, and the luminance data conversion unit 407 modulates luminance by applying the scale factors of a block, so that the displayed image is more exact, natural image quality may be implemented, and power consumption can be reduced.

In summary, the display device of the exemplary embodiments may be driven while reducing power consumption by performing luminance modulation of a non-recognition part of an input image transferred to the display device.

Further, quality degradation of the image implemented by the display device is prevented to provide an image of high quality by detecting the high luminance region of the image to process the image.

In addition, the image can be exactly displayed on a display screen using location information of high luminance It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device comprising:

a display unit including pixels to display an image according to an image data signal corresponding to each of the pixels; and a controller configured to receive and convert an input video signal to transfer a luminance conversion data signal corresponding to the respective pixels, wherein the controller comprises:

an input image data receiving unit configured to receive the input video signal from an external source;

a high luminance region calculation unit configured to detect at least one first region emitting light with luminance of at least a reference value from the input video signal;

a scale factor calculation unit configured to determine at least one control factor for luminance conversion of an input video signal corresponding to the pixels received from the input image data receiving unit; and a luminance data conversion unit configured to convert luminance data of the input video signal into a luminance conversion data signal using the at least one determined control factor, and to output the luminance conversion data signal, and wherein:

the at least one control factor comprises a parameter to determine a luminance variation ratio that varies within a non-recognition luminance range of a viewer during a time period when an image is displayed by the pixels;

the high luminance region calculation unit is configured to separately transfer, to the scale factor calculation unit, luminance data of the input video signal corresponding to the detected first region and luminance data of the input video signal corresponding to a remaining background region, excluding the detected first region;

the scale factor calculation unit is configured to determine a first control factor for luminance conversion of the first region, and to determine a second control factor for the background region; and the luminance variation ratio of the first region is varied in synchronization with the luminance variation ratio of the background region when the first region is detected.

2. The display device of claim 1, wherein the at least one control factor comprises:

a repeating unit time period starting from a maximum value to sustain luminance information of the input video signal during a frame, and ending at a maximum luminance value of a next frame;

a sustain period during which the luminance information of the input video signal is converted and sustained in a step-wise manner;

a number of luminance variation steps in which the input video signal is changed within the non-recognition luminance range;

a lower luminance variation value, which is a minimum luminance value of the non-recognition luminance range used in varying the luminance information;

an upper luminance sustain period for sustaining the maximum luminance value;

a lower luminance sustain period for sustaining the minimum luminance value; and a luminance variation ratio for framing the luminance corresponding to the luminance variation steps.

3. The display device of claim 2, wherein the lower luminance variation limit is determined differently according to grayscale intervals and according to an interval to identify entire grayscales of the input video signal.

4. The display device of claim 1, wherein the scale factor calculation unit is configured to determine a third control factor corresponding for luminance conversion of a second region close to the background region of the first region by linear interpolation between the first control factor and the second control factor.

5. The display device of claim 1, wherein the high luminance region calculation unit is configured to use:

a histogram of the input video signal;

a flag tagged to a video signal having luminance information of at least the reference value in luminance information of the input video signal; or detect blocks when an average value of luminance information of corresponding pixels by blocks comprising pixels is at least the reference value, to detect the first region.

6. A method of driving a display device comprising a display unit including pixels which display an image, and a controller configured to receive and convert an external input video signal into a luminance conversion data signal that is output to the corresponding pixels to display an image, the method comprising:

detecting at least one high luminance region that has a luminance of at least a reference value from the input video signal;

determining at least one control factor for luminance conversion of an input video signal;

converting luminance data of the input video signal into a luminance conversion data signal using the determined at least one control factor; and outputting the converted luminance conversion data signal to the respective pixels to display the image on the display unit, wherein:

determining the at least one control factor comprises:

separating luminance data of the detected high luminance region from luminance data of a remaining background region excluding the detected high luminance region; and determining a first control factor for the luminance conversion of the high luminance region and a second control factor for the background region;

the at least one control factor comprises a parameter to determine a luminance variation ratio within a non-recognition luminance range of a viewer, during a time period that the image is displayed; and the luminance variation ratio of the first region is varied in synchronization with the luminance variation ratio of the background region when the first region is detected.

7. The method of claim 6, wherein the detecting of the high luminance region comprises:

using a histogram of the input video signal;

using a flag tagged to a portion of the video signal having luminance information of at least the reference value; or detecting blocks of the video signal having an average value of at least the reference value.

8. The method of claim 6, wherein the determining of the control factor comprises:

determining a third control factor corresponding to a boundary region close to the background region by linear interpolation between the first control factor and the second control factor.

* * * * *